US005938330A

United States Patent [19]

Robinson et al.

[11] Patent Number: 5,938,330

[45] **Date of Patent: *Aug. 17, 1999**

[54] DYNAMICALLY ENHANCED V-BLENDER

[75] Inventors: Priscilla A. Robinson, Narberth, Pa.; Fernando J. Muzzio, Monroe, N.J.; Dean Brone, Green Brook, N.J.; Kevin Connor, Trenton, N.J.; Carolyn Wightman, Edison, N.J.

[73] Assignees: Merck & Co., Inc., Rahway; Rutgers, The State University of New Jersey, New Brunswick, both of N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 09/003,051

[22] Filed: Jan. 5, 1998

Related U.S. Application Data

[63] Continuation of application No. 08/734,894, Oct. 23, 1996, abandoned

[60] Provisional application No. 60/008,087, Oct. 30, 1995.

[51] Int. Cl.[6] ..... B01F 9/08

[52] U.S. Cl. ..... 366/224; 366/219

[58] Field of Search ..... 366/53–59, 62–63, 366/219–220, 222–224, 233, 318, 348, 349

[56] References Cited

U.S. PATENT DOCUMENTS

| | | | |
|---|---|---|---|
| 2,514,126 | 7/1950 | Fischer . | |
| 2,656,162 | 10/1953 | Fischer et al. | 366/235 X |
| 2,677,534 | 5/1954 | Fischer et al. | 366/235 |
| 2,890,027 | 6/1959 | Fischer . | |
| 2,908,487 | 10/1959 | Fischer . | |
| 4,283,148 | 8/1981 | Peterson | 366/220 |
| 4,571,089 | 2/1986 | Gudlauski et al. | 366/235 X |

FOREIGN PATENT DOCUMENTS

| | | | |
|---|---|---|---|
| 709003 | 5/1954 | United Kingdom | 366/235 |
| 1028978 | 5/1966 | United Kingdom | 366/235 |
| 1033733 | 6/1966 | United Kingdom | 366/235 |

*Primary Examiner*—Charles E. Cooley

*Attorney, Agent, or Firm*—Valerie J. Camara; Mark R. Daniel

[57] ABSTRACT

A study was done to compare the performance of a conventional V-blender to a V-blender that incorporates perturbations of the particle flow by rocking the mixing vessel during its normal rotation. Mixing was investigated using glass beads with sizes from 66$\mu$ to 600$\mu$ in vessels of approximately one liter volume. Mixture uniformity was assessed qualitatively, using two different methods. One method involved a transparent mixing vessel where it was possible to see particle flow patterns and assess the state of the mixture at its surface during the entire experiment. The second method involved disposable aluminum mixing vessels, where the mixture was solidified by infiltrating the mixture with a binder. By slicing the solidified structure, it was possible to assess the entire state of the mixture including its interior structure after the completion of each experiment. Mixture uniformity was also assessed quantitatively using image analysis of the slices. For both particle sizes, the extent of mixing was greatly enhanced using the rocking V-blender compared to the conventional V-blender.

4 Claims, 18 Drawing Sheets

DYNAMICALLY ENHANCED V-BLENDER

RELATED APPLICATIONS

This application is a continuation application of Ser. No. 08/734,894 filed on Oct. 23, 1996 (abandoned), which is based on U.S. provisional application No. 60/008,087, filed on Oct. 30, 1995.

BACKGROUND OF THE INVENTION

V-blenders are widely used in many industries requiring blending, granulating, and drying of powders. V-blenders (also referred to as twin shell blenders) are a type of tumbling mixer consisting of two hollow cylindrical shells or legs, usually of equal length joined at a 90 degree angle (FIG. 1). The mixing vessel is typically connected to a rotating shaft which causes a tumbling motion of the powders within the vessel or shell. The rotating shaft is usually parallel to the ground and perpendicular to the plane of symmetry of the blender. The V-blender may be fitted with an intensifier bar which rotates as much as 100 times the speed of the shell. The intensifier bar is typically positioned along the axis of rotation of the shell. V-blenders are used both in the laboratory as small-scale product development units and in manufacturing as large-scale production units.

Many existing V-blenders use constant speed tumbling motion to mix powders, e.g., V-blenders manufactured by Paul O. Abbe Inc. (Little Falls, N.J.), Bowers Process Equipment Inc. (Stafford, ON), Gemco (Middlesex, N.J.), Jaygo, Inc. (Mahwah, N.J.), Lowe Industries Inc., (Cadiz, Ky.), Patterson Industries Ltd. (Scarborough, ON), and Patterson-Kelley (East Stroudsburg, Pa.). In most cases, a mixture is considered well mixed when the standard deviation of samples taken from the mixture are equal to the standard deviation of a random mixture or fall within an acceptable variation for a particular application.

There have been numerous reports of incomplete or slow mixing in these devices. Gray found that a mixture of sand and ilmenite continued to improve its mixedness even after 1000 revolutions at 24 rpm. (Gray, J., "Solids Mixing Equipment", *Chem. Eng. Progr.,* 53, (1957), 25). Wiedenbaum et al. found that a random mixture of same-sized sand and salt particles was not obtained even after 5000 revolutions at 24 rpm. (Weidenbaum, S. S., et al., "Mixing of Solids in a Twin Shell Blender", *Ceramic Age,* 79, (1963), 39) Chowhan and Linn found that it took approximately 1100 revolutions at 24 rpm to obtain a well mixed system of a cohesive drug with a free flowing excipient. (Chowhan, Z. T., et al., "Mixing of Pharmaceutical Solids, *Powder Technology* 24, (1979), 237) Cahn, et al. needed 1000 revolutions at 24 rpm to obtain a well mixed system of same sized $CaCO_3$ and $SiO_2$ particles. (Cahn, D. S., et al., "Blender Geometry in the Mixing of Solids", *Ind. Eng. Chem., PD&D,* 4, (1965), 318) Carstensen and Patel found that a system of same-sized lactose and cornstarch was not sufficiently mixed in 500 revolutions at 24 rpm. (Cartensen, J. T., et al., "Blending of Irregularly Shaped Particles, *Powder Technology,* 17, (1977), 273) Harnby found that a mixture of millet and salt exhibited significant segregation after 1000 revolutions at 33 rpm. (Harnby, N., "A Comparison of the Performance of Industrial Solids Mixers Using Segregating Materials, *Powder Technology,* 1, (1967) 94) Samyn and Murthy found that 118$\mu$ aspirin and 87$\mu$ lactose took 60 minutes to mix, although the rotation rate was not specified. (Samyn, J. C., et al., "Experiments in Powder Blending and Unblending, *J. Pharm. Sci.* 63, (1974) 371).

The main type of segregation in these experiments was found to be axial segregation. A conventional V-blender has no mechanism to induce flow in this direction, hence segregated regions may persist for long times. Three variations from the conventional V-blender may improve mixing by perturbing the axial flow. These include V-blenders with (1) legs of different lengths (P-K Cross-Flow™ Blender, Patterson Kelley, East Strousburg, Pa.), (2) the rotating shaft mounted parallel to the ground but offset from the orthogonal to the plane of symmetry of the blender (Challenger™ Offset™ V-Blender, Lowe Industries, Inc., Cadiz, Ky.), and (3) rotating blades mounted to rotate in the plane of the 'V' of the blender (Chopper blades, Lowe Industries, Inc., Cadiz, Ky.)

An improved mixing method is disclosed in this patent application, consisting of a V-blender wherein mixing is enhanced by a controlled axial flow perturbation. As an example, perturbations are introduced by rocking the device with respect to its axis. Such perturbations produce a convective axial flow, resulting in large accelerations of the mixing process. It is claimed that similar enhancements could also be obtained by using other means to perturb the flow of particles.

SUMMARY OF THE INVENTION

The invention relates to a method for enhancing the mixing of solids using a V-blender and a controlled axial flow perturbation. Also within the scope of this application is the V-blender apparatus capable of introducing a controlled axial flow perturbation to enhance the mixing of solids.

BRIEF DESCRIPTION OF THE FIGURES

The file of this patent contains at least one drawing executed in color. Copies of this patent with color drawing (s) will be provided by the Patent and Trademark Office upon request and payment of the necessary fee.

without rocking and (b) with rocking at +/−10 degrees at a rocking ratio of 3.14 revolutions per rocking cycle.

FIG. 13 Photographs of the solidified mixture after slicing through various sections, with and without rocking in addition to rotation: 13(*a*) left edge slice with no rocking; 13(*b*) left edge slice with rocking; 13(*c*) center slice with no rocking; 13(*d*) center slice with rocking; 13(*e*) right edge slice with no rocking; 13(*f*) right edge slice with rocking. The red and green beads were initially in the left and right legs, respectively.

Figure 14A:
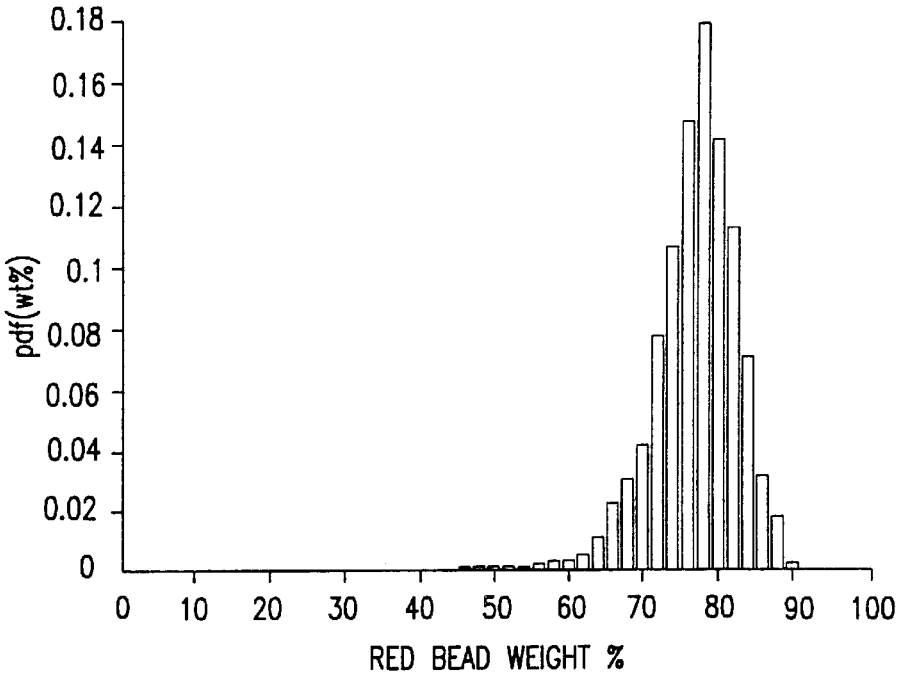
Figure 14B:
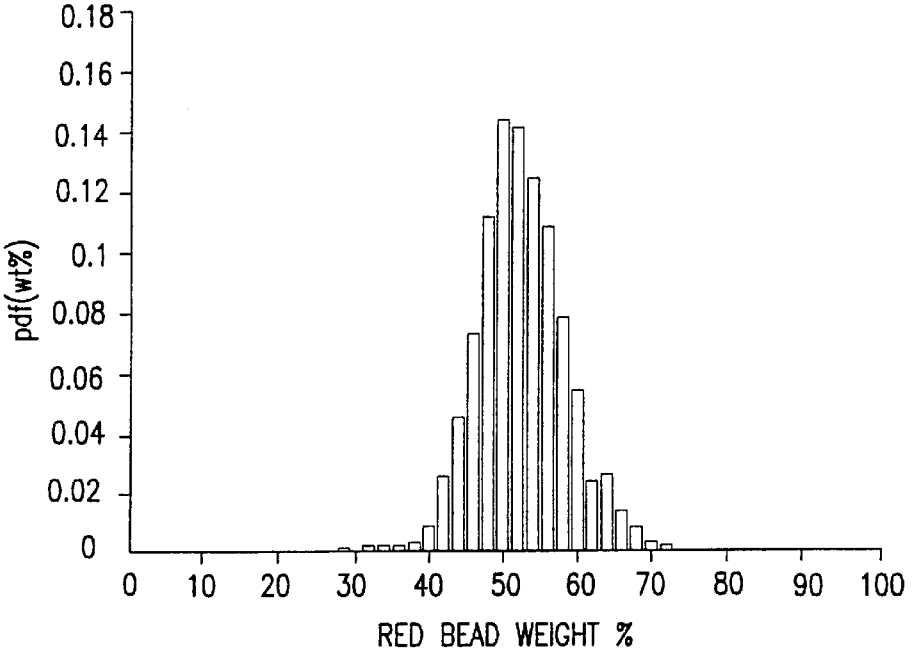
Figure 14C:
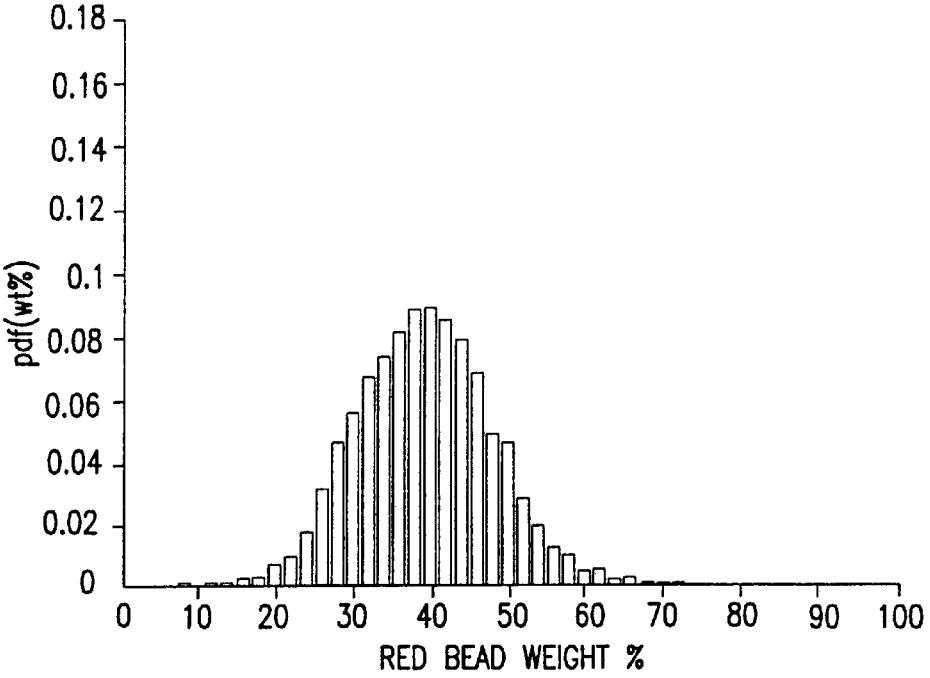
Figure 14D:
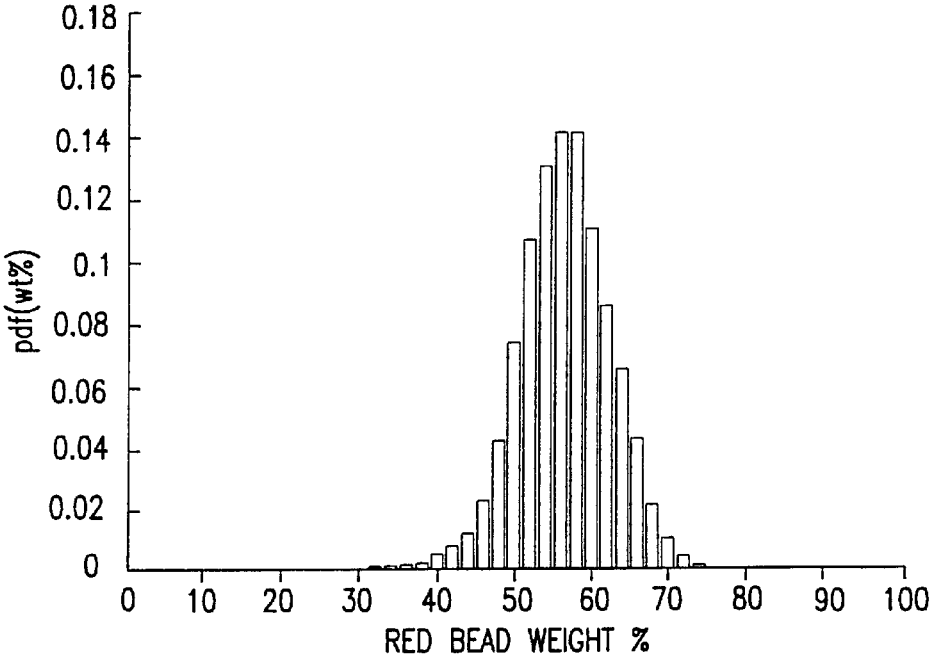
Figure 14E:
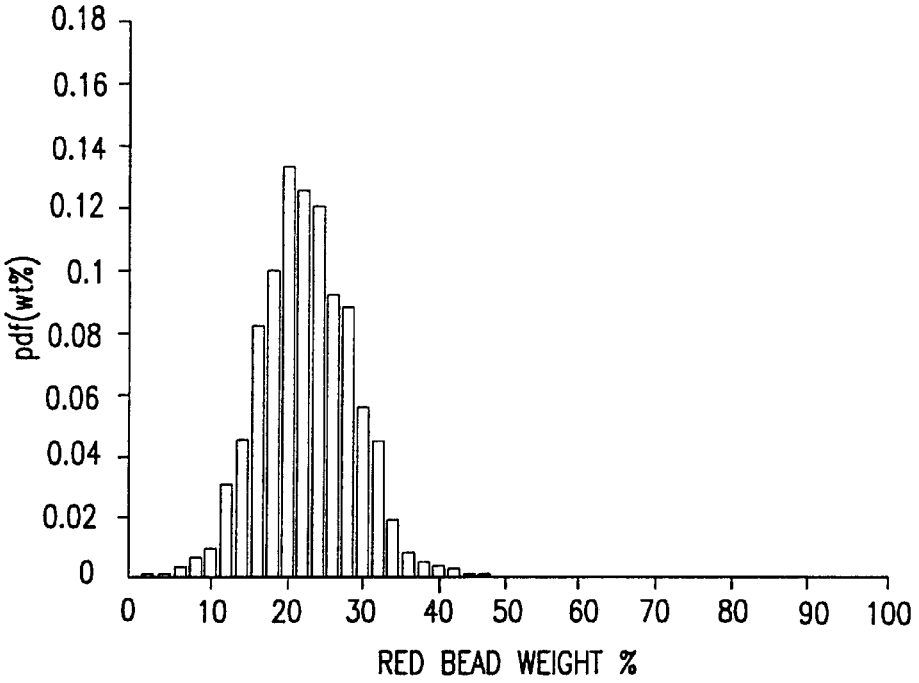
Figure 14F:
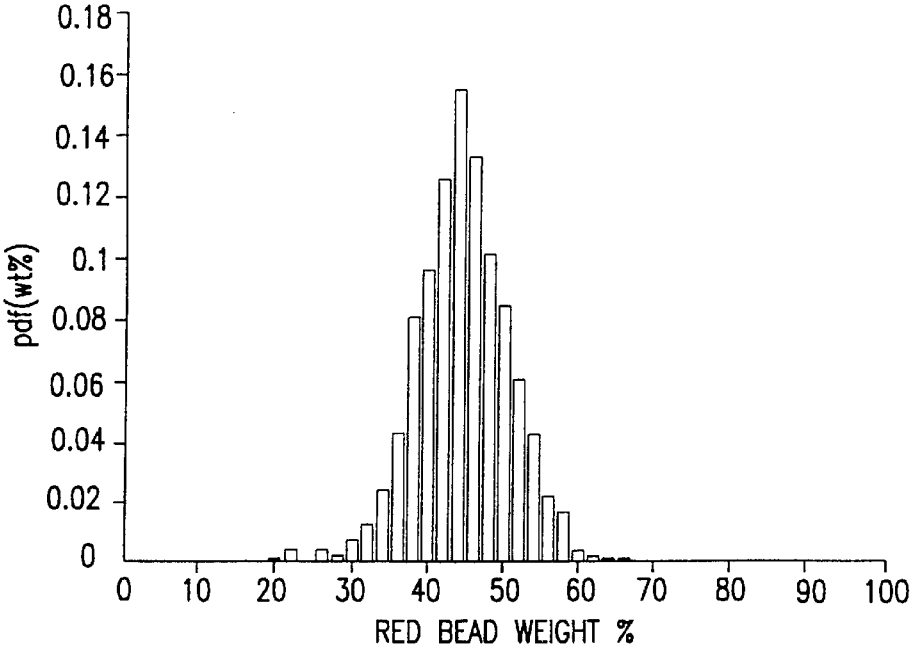

FIG. 14 Probability distribution functions of red bead concentrations for: solidified left edge slice FIG. 14(A) pure rotation and FIG. 14(B) rotation with rocking (sheet 14/18); solidified center slice FIG. 14(C) pure rotation and FIG. 14(D) rotation with rocking (sheet 15/18); and solidified right edge slice FIG. 14(E) pure rotation and FIG. 14(F) rotation with rocking(sheet 16/18).

Figure 15B:
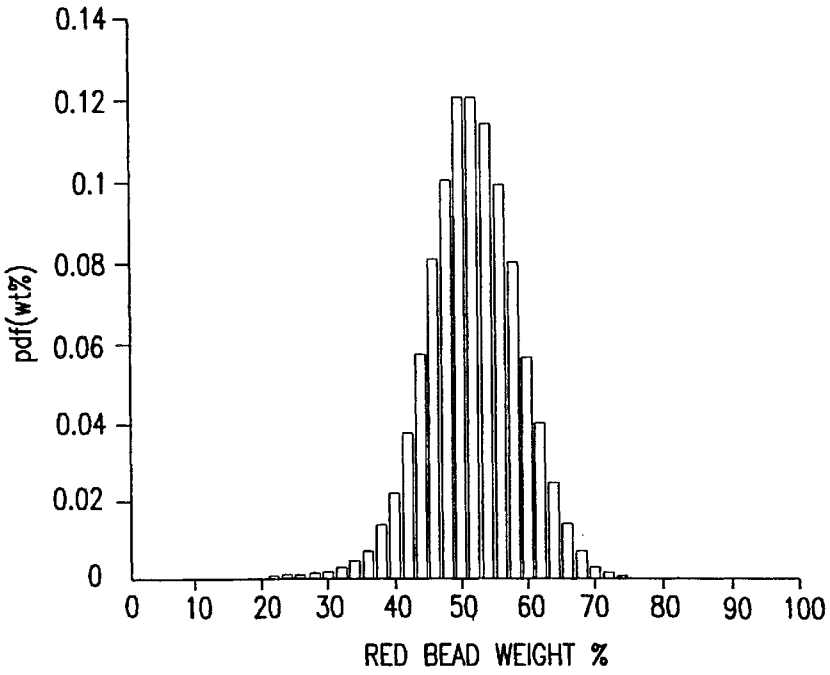
Figure 15A:
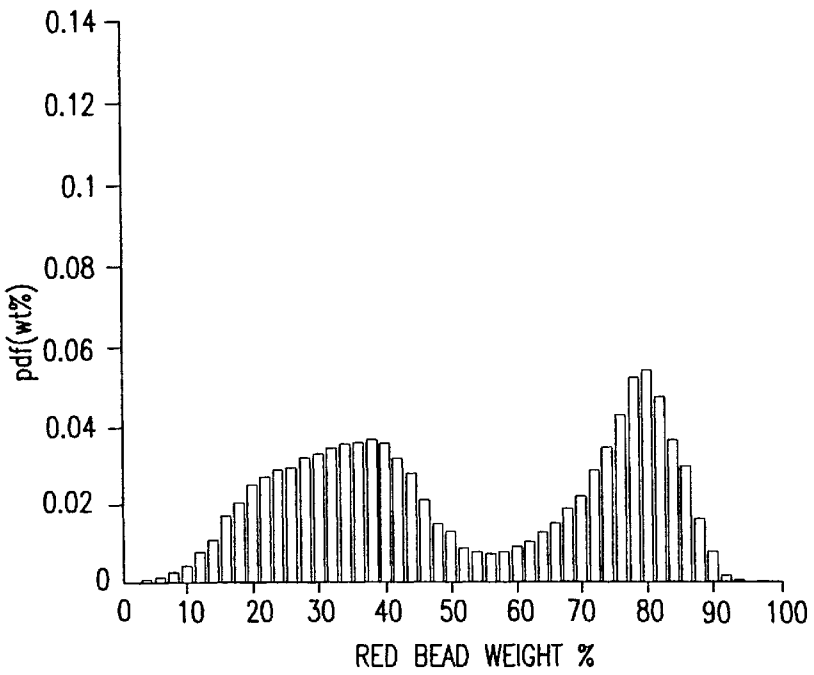

FIG. 15 Probability distribution functions of the overall red bead concentration for (a) pure rotation and (b) rotation with rocking.

Figure 16A:
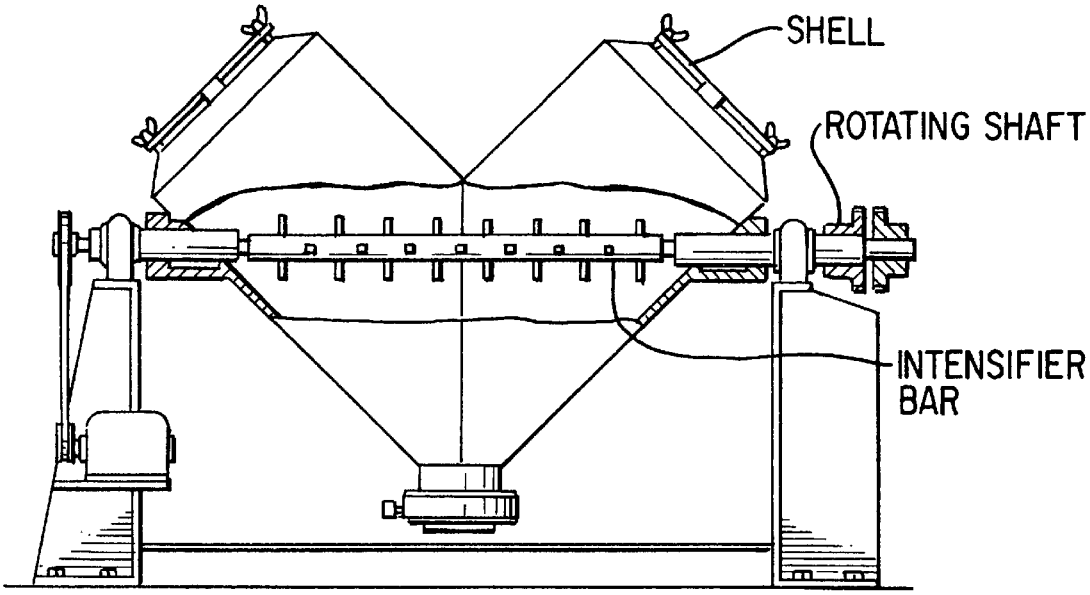
Figure 16B:
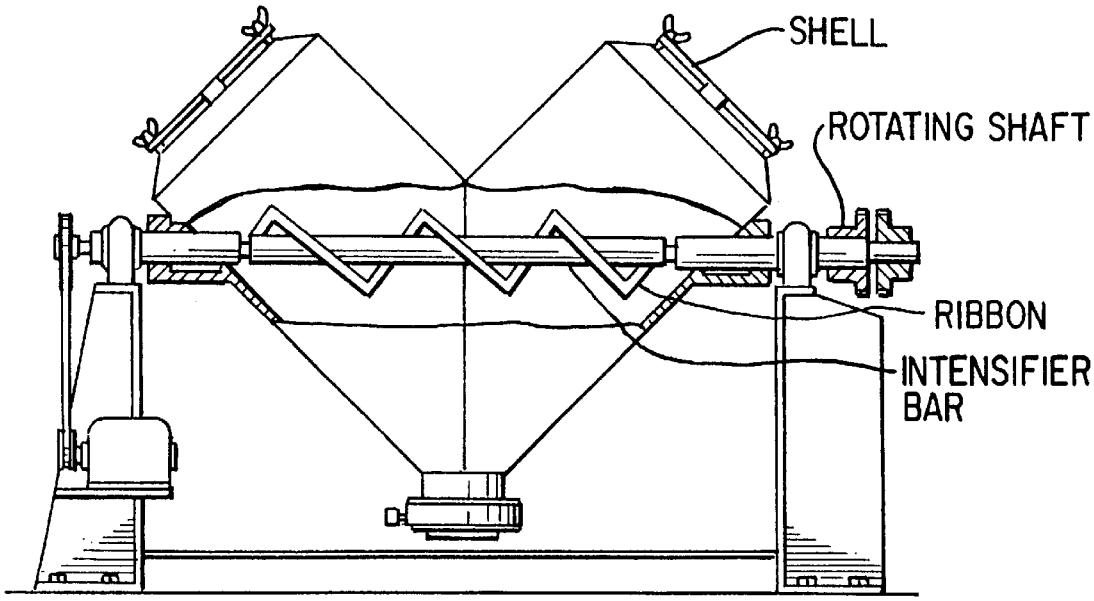

FIG. 16 16(*a*): Schematic of V-blender shell showing rotating shaft and intensifier bar. 16(*b*): Schematic of V-blender shell showing rotating shaft, intensifier bar, and ribbon.

DETAILED DESCRIPTION OF THE INVENTION

The invention relates to a method for mixing solids in a V-blender comprising controlled axial flow perturbations.

An embodiment of this method is where the controlled axial flow perturbation is selected from the group consisting of:

(a) rotation of the shell with a rocking motion, (b) time-dependent rotation speed of the shell with a rocking motion, (c) time-dependent, reversible rotation direction of the shell with a rocking motion, (d) rotation of the shell with a ribbon rotation, and (e) rotation of the shell with a time-dependent direction of rotation of the ribbon attached to an intensifier bar.

The method wherein the controlled axial flow perturbation is introduced by combined rotation of the shell with rocking motion, which is defined by a rocking angle of about 0 degrees to about +10 degrees or −10 degrees, a speed of rotation of about 0 to about 50 rpm, and a rock to roll frequency of about 0 to about 31.4. As used herein, rocking angle refers to the angle swept by the motion of an imaginary plane that runs through the axis of rotation of the shell and is parallel to the ground. The preferred conditions for the combined rotation of the shell with rocking motion are defined by a rocking angle of about +10 degrees to about −10 degrees, and a rock to roll frequency of about 1.8.

The method wherein the controlled axial flow perturbation is introduced by combined time-dependent rotation speed of the shell with rocking motion, and is defined by a speed of rotation of about 0 to about 50 rpm, a frequency of rotation rate changes per revolution of about 0 to about 1, a rocking angle of about 0° to about +10 degrees or −10 degrees, and a rock to roll frequency of about 0 to about 31.4.

The method wherein the controlled axial flow perturbation is introduced by combined time-dependent rotation direction of the shell with a rocking motion, and is defined by a speed of rotation of about 0 to about 50 rpm, and a frequency of rotation direction changes per revolution of about 0 to about 1, rocking angle of about 0° to about +10 degrees or −10 degrees, and a rock to roll frequency of about 0 to about 31.4.

The method wherein the controlled axial flow perturbation is introduced by combined rotation of the shell with ribbon rotation, and is defined by a speed of the shell of about 0 to about 50 rpm and a ribbon speed of about 0 to about 3600 rpm.

The method wherein the controlled axial flow perturbation is introduced by combined rotation of the shell with time-dependent ribbon rotation speed, and is defined by a speed of the shell of about 0 to about 50 rpm, a ribbon speed of about 0 to about 3600 rpm and frequency of ribbon rotation direction changes per shell revolution of about 0 to about 1.

A V-blender wherein a controlled axial flow perturbation is introduced by:

(a) combining rotation of the shell with a rocking motion, (b) combining a time-dependent rotation speed of the shell with a rocking motion, (c) combining a time-dependent rotation direction of the shell with a rocking motion, (d) combining a rotation of the shell with a ribbon rotation, and (e) combining a rotation of the shell with a time-dependent ribbon rotation direction.

The ribbon rotation is defined as the rotation of a ribbon which is attached to an intensifier bar of a V-blender.

In order to examine the effects of well-controlled flow perturbations on mixing processes inside a partially filled V-blender, a custom-designed mixing apparatus was built. Rotational and rocking motions (FIG. 2) were independently controlled using two stepping motors (Arrick Robotics, Hurst, Tex.) interfaced to a computer (Gateway 2000, North Sioux City, S. Dak.). One motor was directly linked to the drive shaft and enabled the mixing vessel to rotate. The other motor was linked to the frame that housed the drive shaft by means of a screw shaft. It enabled the frame to rotate partially around a pivot and imparted a vertical rocking motion on the mixing vessel. A motor-control computer program was developed to enable precise independent control of both the rotational and rocking frequencies. The program synchronized movement of both motors.

Figure 1:
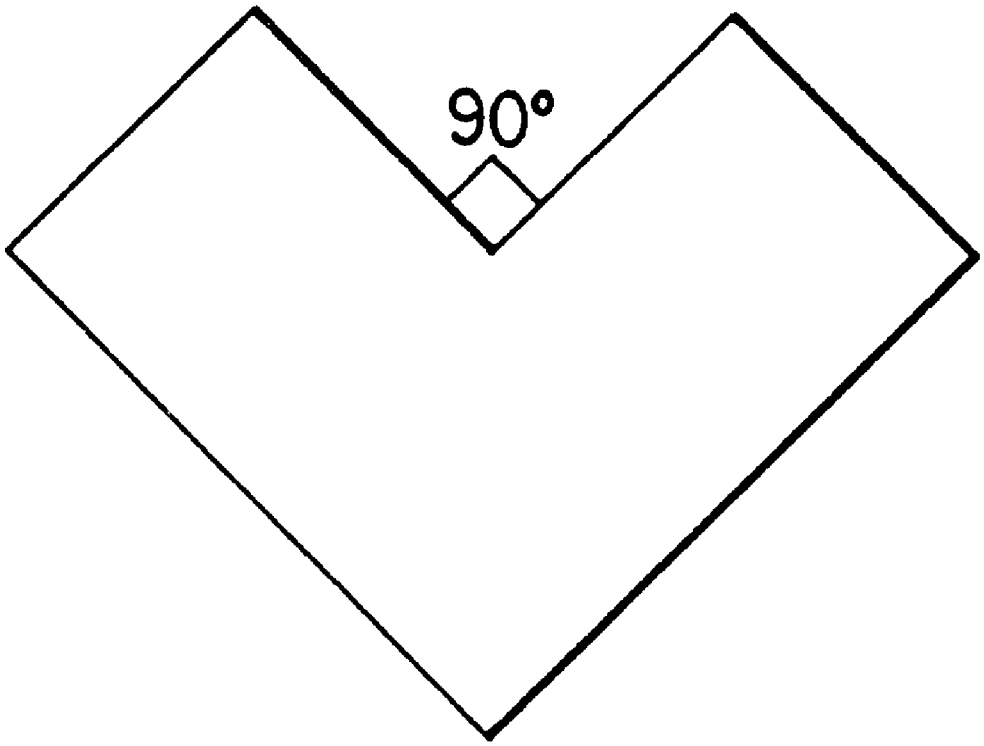
FIG. 1 Schematic of a V-blender (twin shell blender) mixing vessel.
Figure 2B:
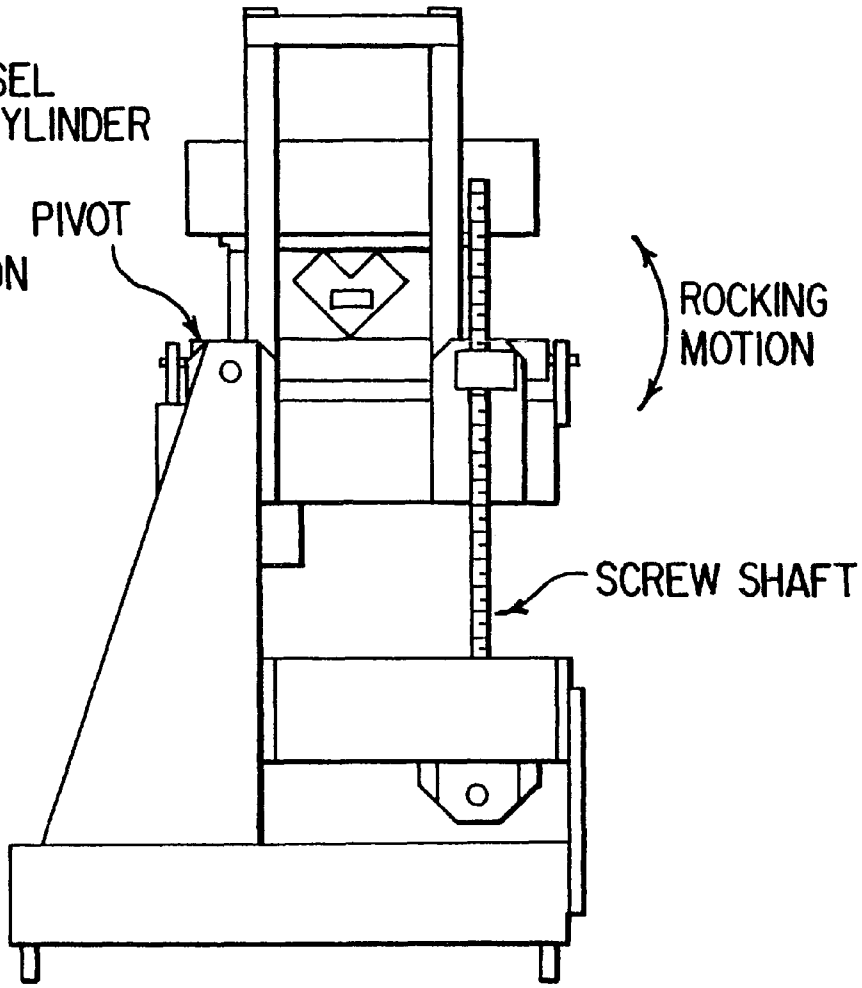
FIG. 2 Schematic of a Plexiglas V-blender mounted within a Plexiglas cylinder (a) frontal view and (b) side view at a 90 degree angle to frontal view.
Figure 2A:
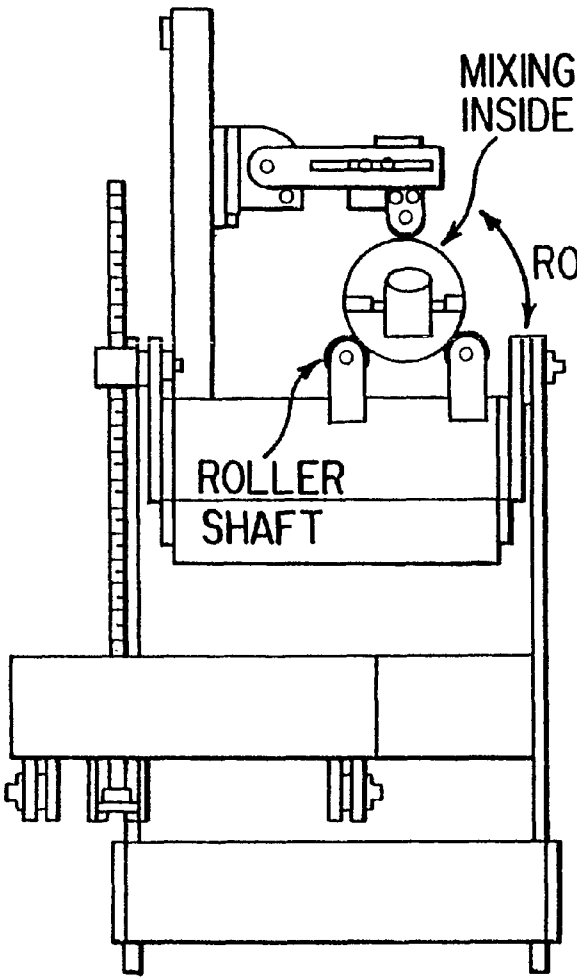

Two types of experiments were used to demonstrate the mixing enhancements obtained by application of rocking motion. In the first experiment, direct visualization of the mixing processes was achieved using commercially available Plexiglas V-blender vessels (Patterson Kelley Company Inc., East Stroudsburg, Pa.) that were 3 inches in diameter, 6 inches long and had a 90 degree angle connection between shells. These Plexiglas V-blender vessels were fitted inside a 10 inch diameter Plexiglas cylinder, which was suspended on top of two rollers and held in place from above by a third, freely rotating roller (FIG. 2). During a given experiment, the rotation rate, mixing time and number of rotations per rocking cycle were specified, with the remaining parameters necessary to control the motors then being calculated. Each rocking cycle consisted of a 10 degree downward tilt, followed by a rise back to the horizontal position and a 10 degree tilt in the opposite direction. A cycle was complete when the mixer returned to the horizontal position.

Figure 3A:
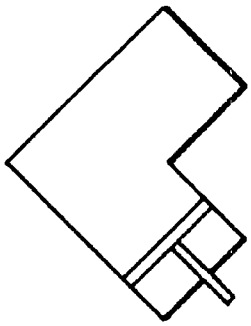
FIG. 3 Vessel loading procedure: (a) plunger inserted, (b) red beads are added to one leg, (c) green beads are added to second leg, and (d) vessel turned to upright position.
Figure 3B:
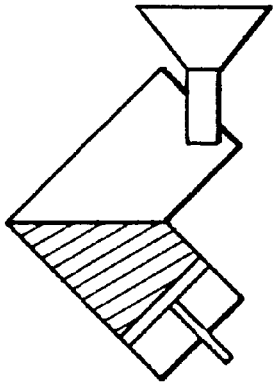
Figure 3C:
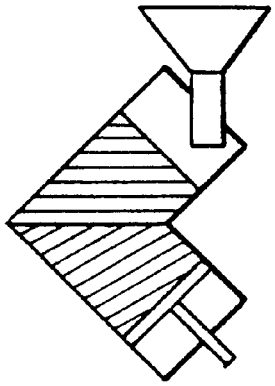
Figure 3D:
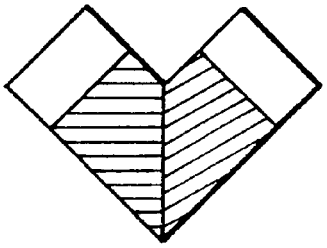
Figure 4:
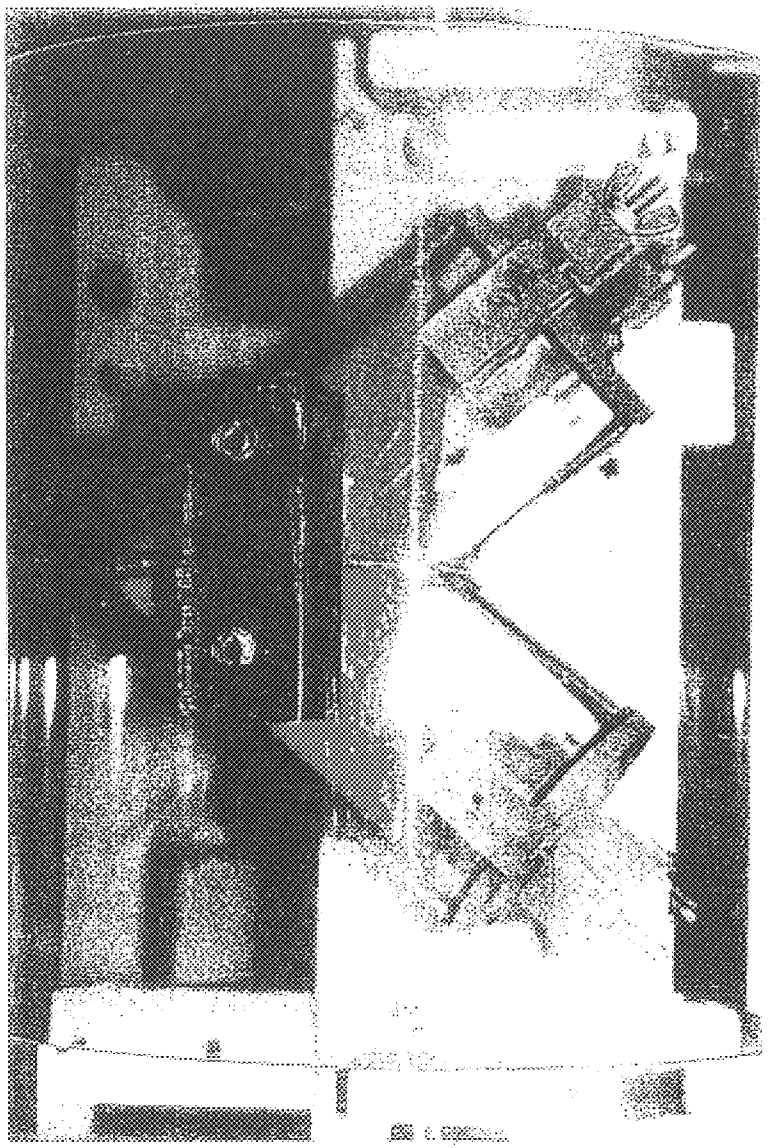
FIG. 4 Initial conditions for mixing experiments, beads are initially segregated into the two legs.

Red and blue 600$\mu$ glass beads (Jaygo Inc., Union, N.J.) were used in the direct visualization experiments. The total loading for each experiment was 50% of the total vessel volume. The vessels were loaded axially, with one color being loaded into each shell. This was done one color at a time. First a plunger was inserted into one end of the twin shell (FIG. 3*a*). A measured amount of red beads was added into the other end of the shell (FIG. 3*b*) and the plunger depth was then adjusted until the level of beads was at the centerline of the twin shell. A measured amount of green beads was then carefully added on top of the layer of red beads (FIG. 3*c*) so that the red/green interface between the beads was maintained along the centerline of the twin shell. Finally, the vessel was carefully turned upright (FIG. 3*d*) and the ends of the twin shell were closed with caps. A photograph of the initial condition for an experiment is shown in FIG. 4.

Figure 5B:
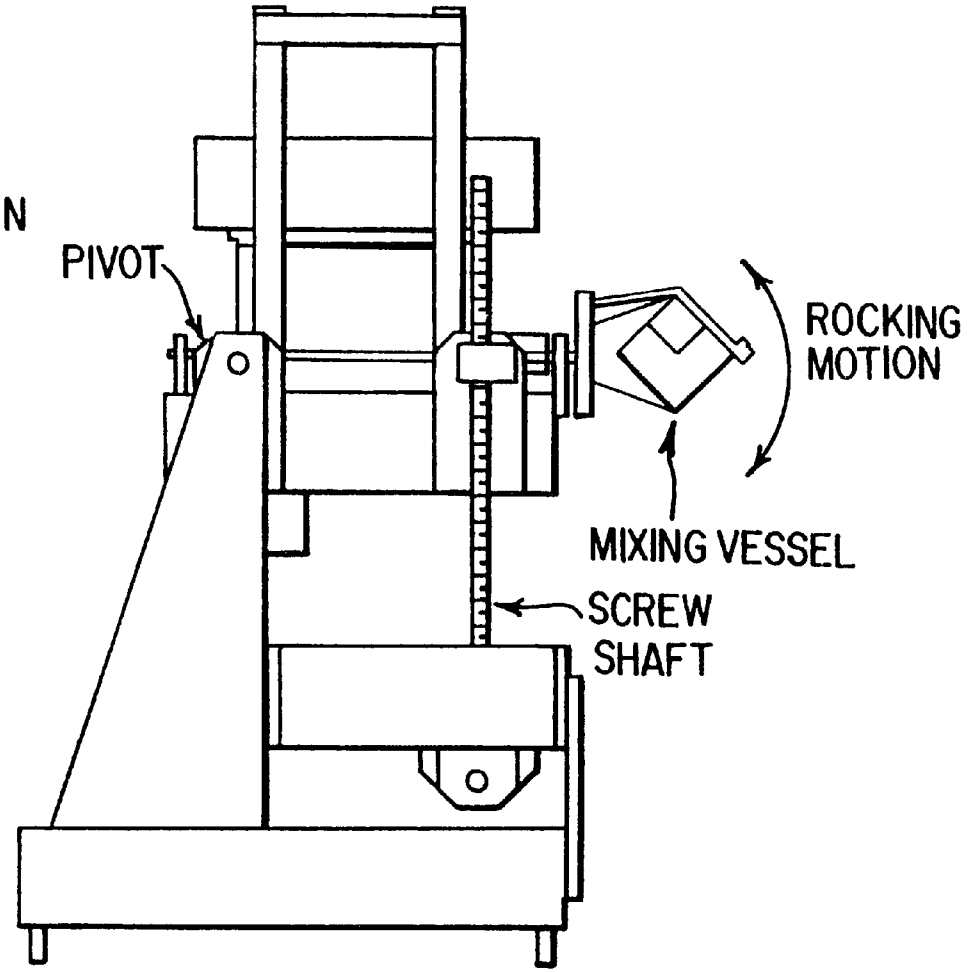
FIG. 5 Schematic of V-blender mounting for the metal vessel (a) frontal view and (b) side view at a 90 degree angle to frontal view.
Figure 5A:
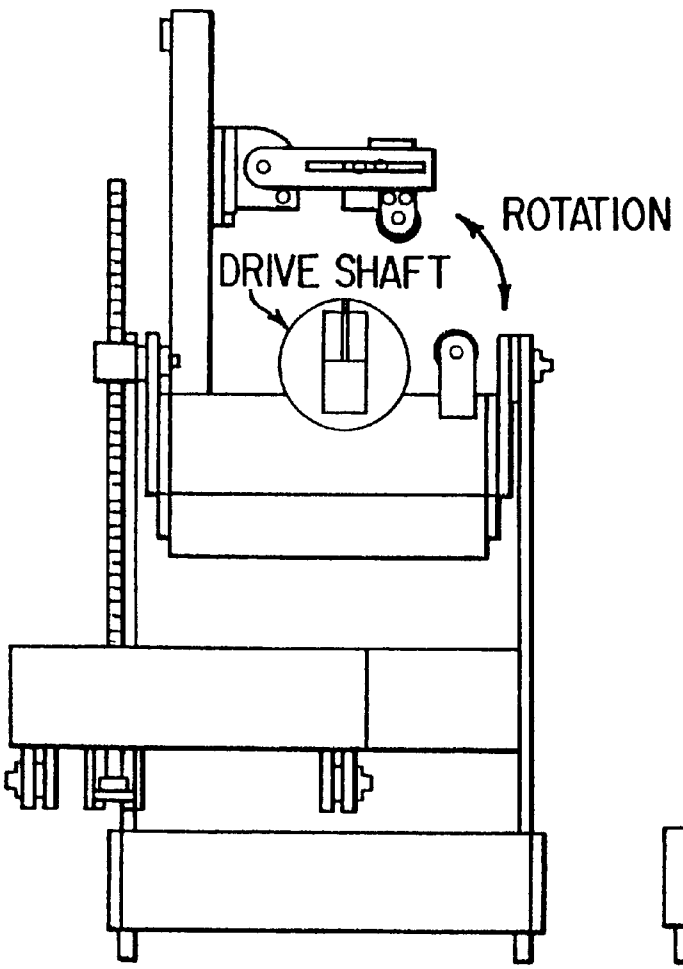

The second type of experiment was designed to facilitate examination of the structure of the mixture throughout the entire volume of the powder bed. At the end of the mixing experiment, the structure of the mixture was preserved by infiltrating the voids between particles with a polymer solution, which was allowed to cross-link, yielding a solidified monolith. This monolith was subsequently sliced to reveal the internal structure of the mixture. These solidification experiments were carried out in custom-made aluminum twin shell vessels (American Aluminum Co., Mountainside, N.J.) that had identical dimensions and were loaded in the same manner as the Plexiglas V-blender vessels. In order to achieve a wider range of rotational and rocking speeds, one of the rollers in the computer-controlled drive was replaced by a shaft with a mounting extension. The twin shell vessels were housed inside a frame attached to the mounting extension (FIG. 5).

Figure 6:
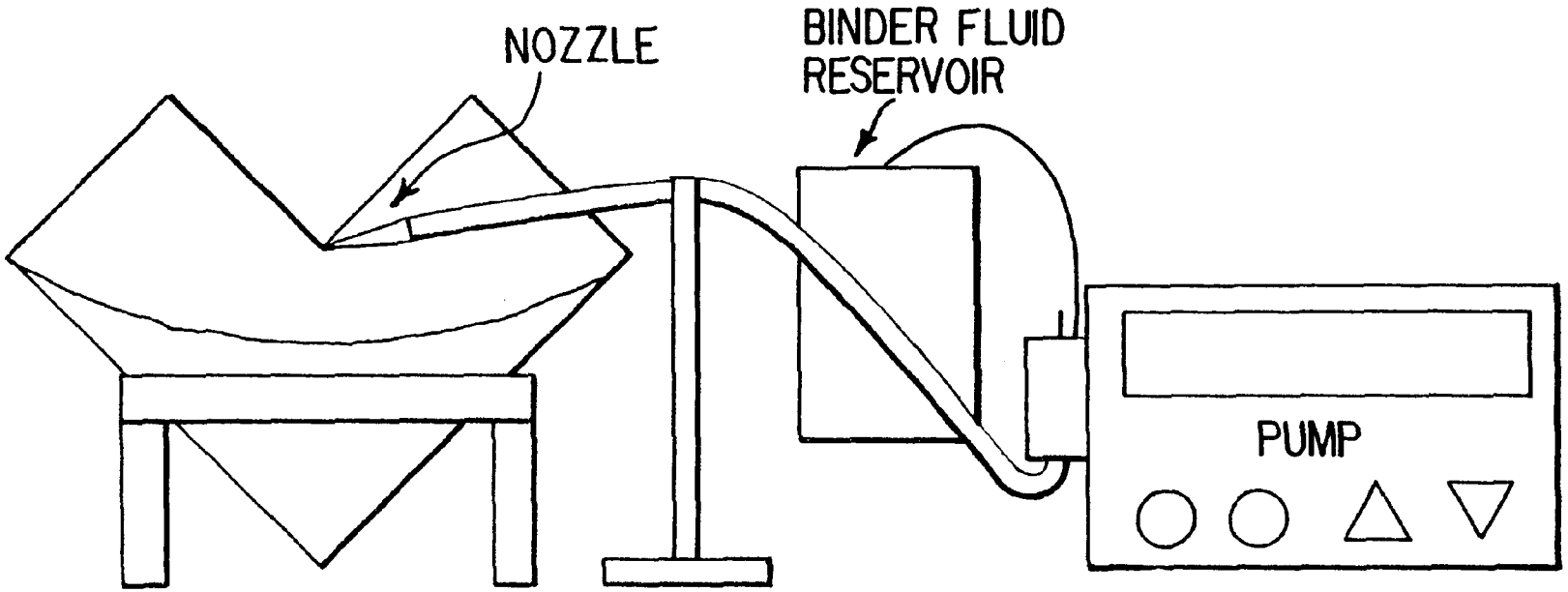
FIG. 6 Schematic of infiltration apparatus including fluid reservoir, pump, and solution delivery system.

Red and green 66$\mu$ glass beads (Potters Industries Inc., Parsippany N.J.) were used in the solidification/slicing experiments. After the mixing run was completed, the twin shell vessel was carefully removed from the mixing apparatus without disturbing the mixture. It was then placed into an infiltration apparatus where it was held in a secure horizontal position. The infiltration apparatus, shown in FIG. 6, consisted of a fluid reservoir, a pump, and tubing connected to a nozzle. The infiltration medium used was a commercially available mixture of SD alcohol 40, water, octylacrylamide, acrylates and butylaminometh-acrylate copolymer (Rave®, Chesebrough Ponds USA Co., Greenwich, Conn.). The medium was pumped slowly onto the mixture to avoid trapping air in the system. The nozzle was placed at the centerline of the vessel near the wall allowing the medium to flow gently onto the powder bed, which pushed the air out slowly through the open ends of the vessel. Repeated experiments have shown that the infiltration process does not cause any disturbances to the mixture. The embedded mixtures were allowed to dry for a period of about two weeks.

Figure 7:
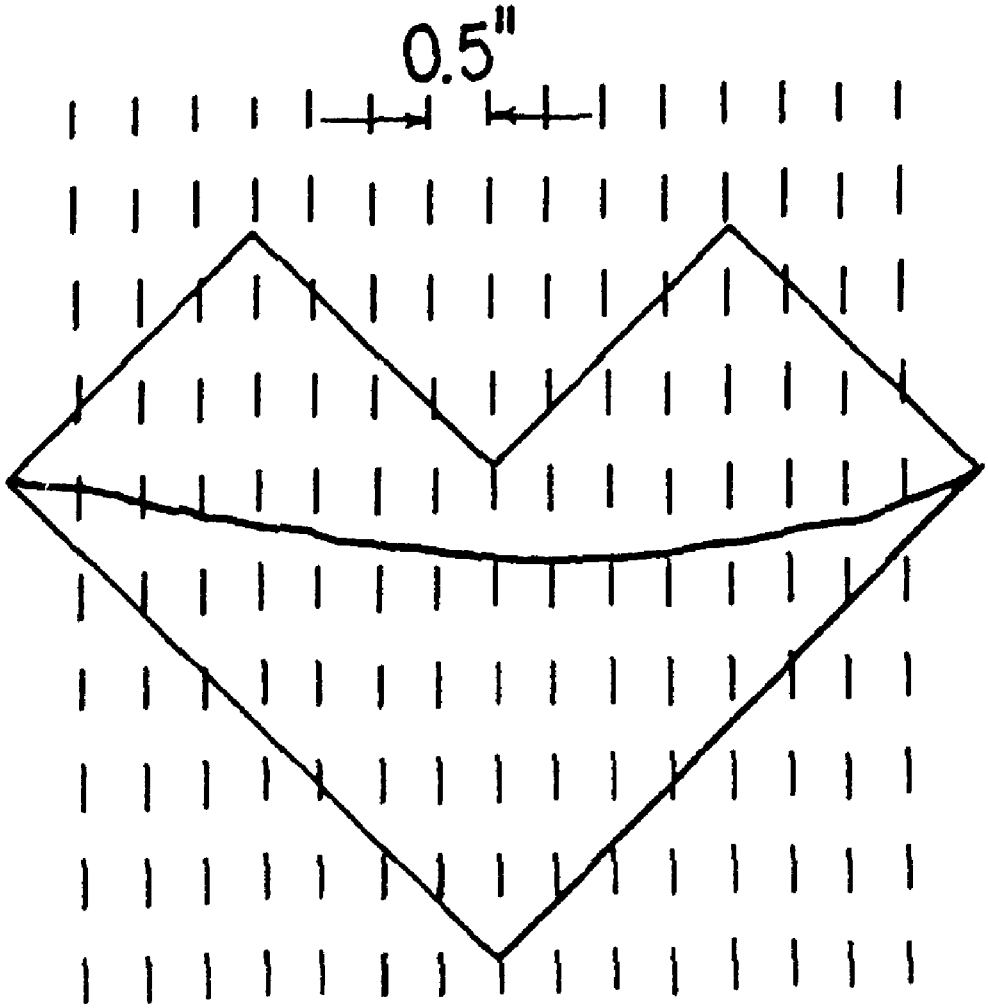
FIG. 7 Slicing pattern for solidified mixtures.

The solidified structures were removed from the vessels and sliced using a bandsaw. First the mixing vessel was sliced along the centerline while the vessel still contained the mixture. The two shells were then cut along the top surface of the solidified beads. After briefly heating the shells, the solidified structures were easily detached from the shell walls and removed from the vessels. The structures were then sliced in half inch intervals along the axis of rotation as shown in FIG. 7. Each experiment resulted in about fourteen sections.

Figure 8A:
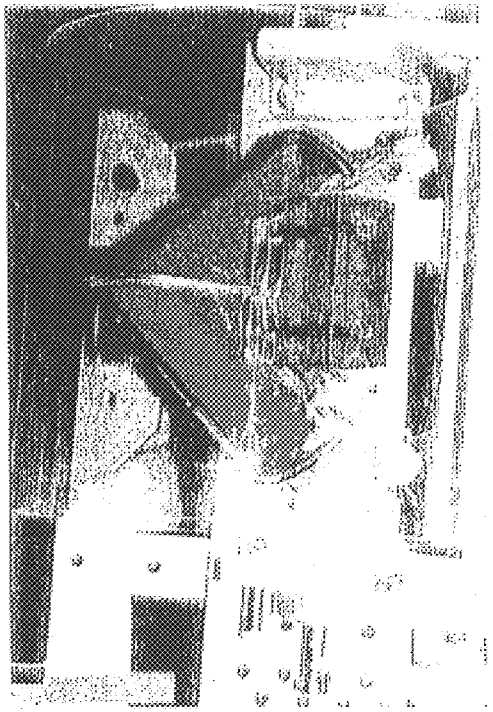
FIG. 8 Exterior structure of 600 micron particles mixed at 16 rpm for (a) 5 minutes without rocking, (b) 45 minutes without rocking, and (c) 5 minutes with a rocking ratio of 3.14 revolutions per rocking cycle where the rocking motion is at +/−10 degrees.
Figure 8B:
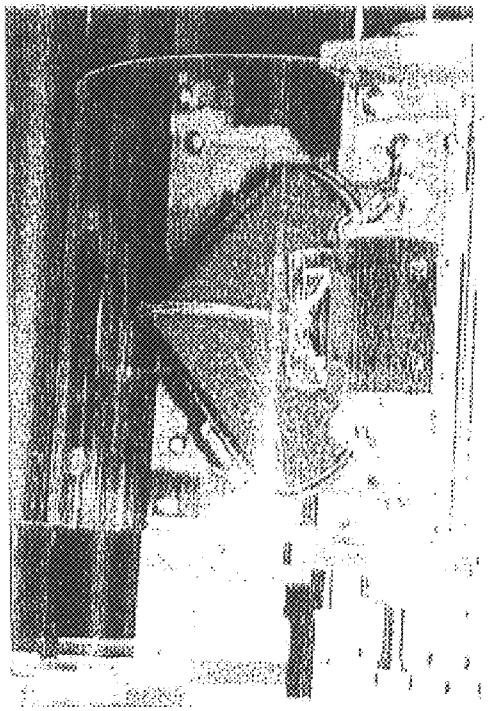
Figure 8C:
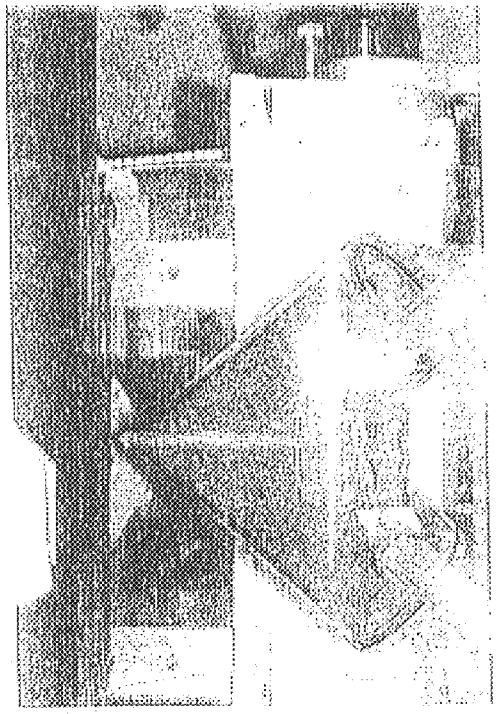

The effect of rocking motion on mixing in a twin shell mixer is shown in FIG. 8. FIG. 8*a* is the state of the mixture after five minutes of pure rotation at 16 rpm. A comparison between FIG. 8*a* and the initial condition (FIG. 4) shows that only a minimal amount of mixing has occurred. Even after 45 minutes of mixing without rocking (FIG. 8*b*), the red and green beads were not completely mixed. In contrast, FIG. 8*c* shows the state of the mixture after 5 minutes of mixing at 16 rpm with rocking. A ratio of 3.14 revolutions per rocking cycle was used in this experiment. In this case the beads appear to be very well mixed.

Figure 9A:
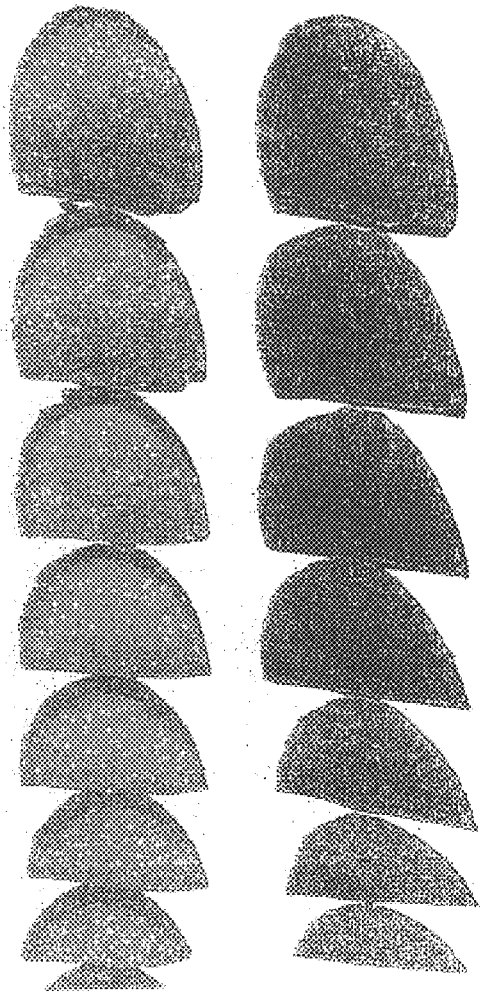
FIG. 9 Interior mixing patterns of 66 micron particles mixed at 16 rpm for 10 minutes with (a) no rocking and (b) a rocking ratio of 3.14 revolutions per rocking cycle where the rocking motion is at +/−10 degrees.
Figure 9B:
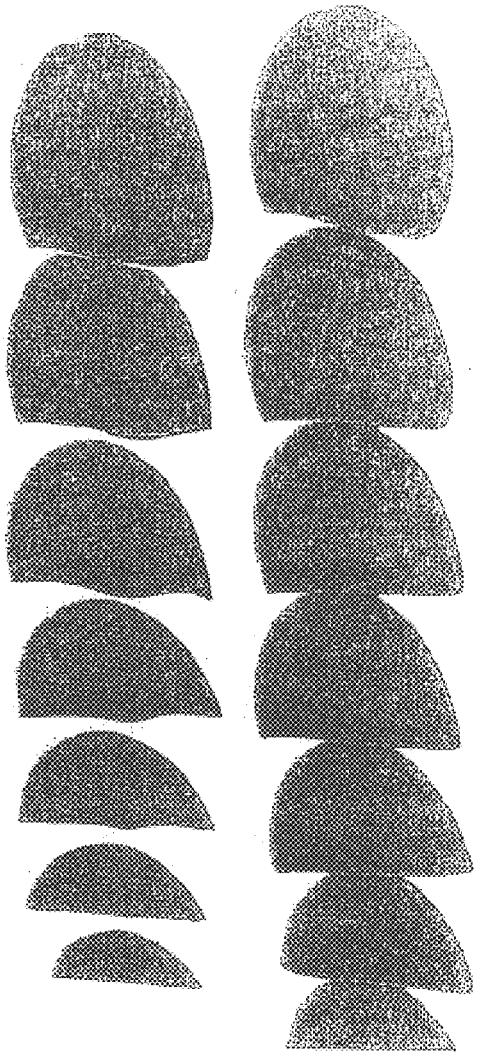

The interior mixing patterns were determined for a similar set of conditions and are shown in FIG. 9. After slicing, the slices were rotated 90 degrees to reveal the mixing structure along the axis of rotation. FIG. 9*a* is a photograph of an experiment carried out with a rotation rate of 16 rpm for a total mixing time of 10 minutes with no rocking. As can be seen in the photograph, the composition of each slice along the axis of rotation varies greatly from one end of the structure to the other. FIG. 9*b* is a photograph of an experiment carried out using rocking. The experiment corresponds to a rotation rate of 16 rpm, the same total mixing time as before (10 minutes) and a ratio of 3.14 revolutions per rocking cycle. In this case the composition is essentially the same for all slices. The entire structure is extremely well mixed; it is only upon careful inspection that one can determine which end of the mixer was initially red and which was initially green.

Figure 10:
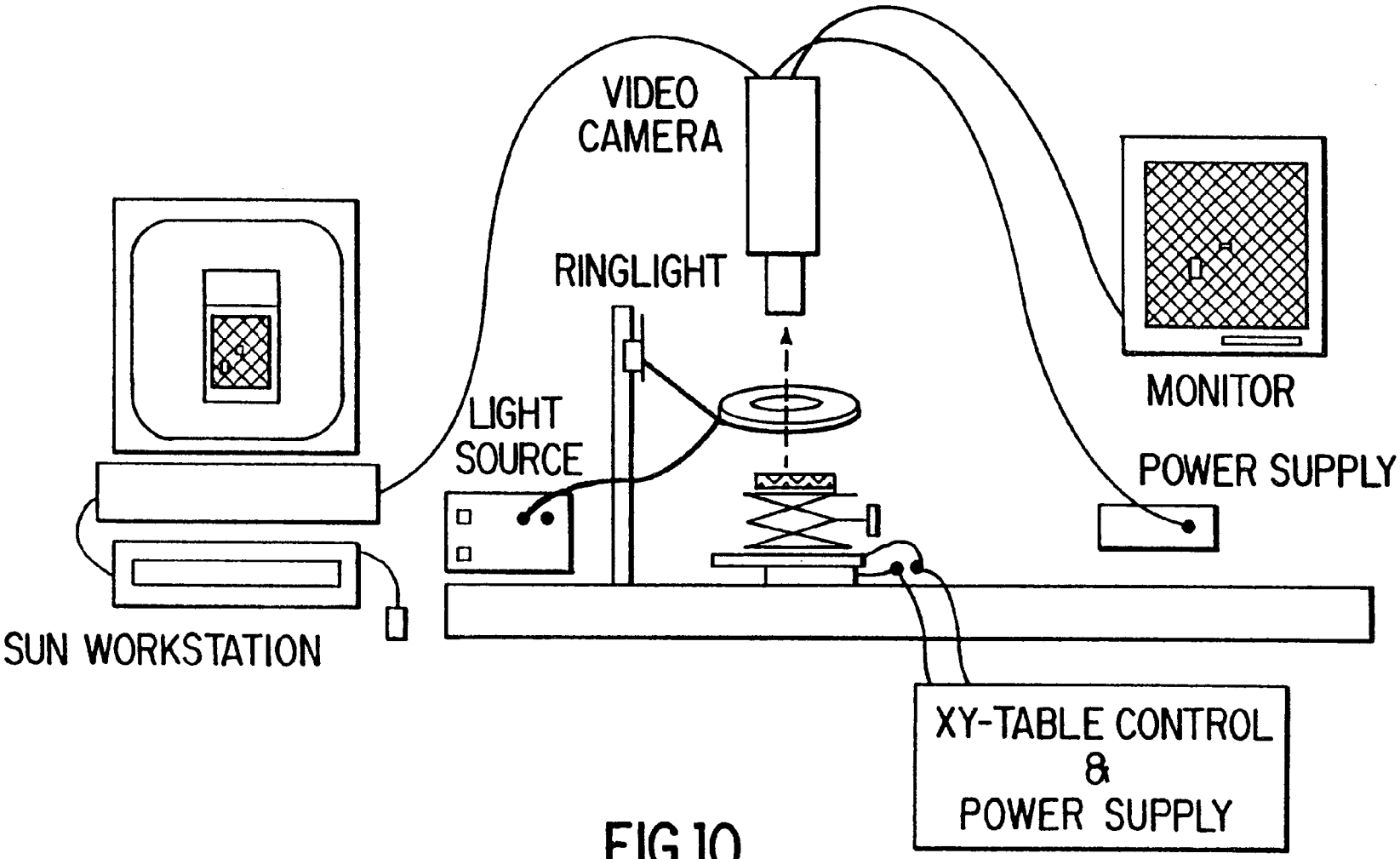
FIG. 10 Schematic of the image analysis equipment setup.

Quantitative mixing data is obtained from the slices using image analysis. Mixture sections are sequentially recorded as digital 8 bit gray-scale images, and analyzed using numerical algorithms. FIG. 10 depicts the image analysis equipment setup. A 6510 CCD monochrome camera (Cohu Inc., San Diego, Calif.) with a Computer 55 mm F/2.8 telecentric video lens (Edmund Scientific Company, Barrington, N.J.) is mounted vertically above the image. Sufficiently uniform illumination of the field of view is attained by a fiber optic ring light (Volpi Manufacturing USA, Auburn, N.Y.). This light source is supplied by a 150-watt halogen bulb housed in an Intralux 6000-1 controller (Volpi Manufacturing USA, Auburn, N.Y.). For mixtures of red and green glass beads, a sharp cut filter (R-60, Newport Corporation, Irvine, Calif.) is used to attenuate the shorter wavelengths (690 NM or less) while transmitting the longer wavelengths. Use of such a filter maximizes gray scale contrast of the red and green components. The red component becomes the brightest; the green component, the darkest. Each slice is scanned with the aid of a programmable xy-table (Unidex Aerotech Inc., Pittsburgh, Pa.) operated remotely by a computer. The video signal is digitally displayed as an 8 bit image (256 gray levels) on an RS-170 picture monitor (Sony Trinitron Model No. PVM-1342C, Sony Corp., Tokyo, Japan). The output signal from the monitor is sent to an MV20 image processing board (Datacube Inc., Danvers, Mass.) where the signal is converted from analog to digital. The image is displayed as a gray-scale image on a Sun Workstation (Sun, Mountain View, Calif.), where an image processing software program (recently developed at the Center for Computer Aids for Industrial Productivity, Rutgers University, Piscataway, N.J.) handles the video signal, data retrieval, and storage.

Figure 11:
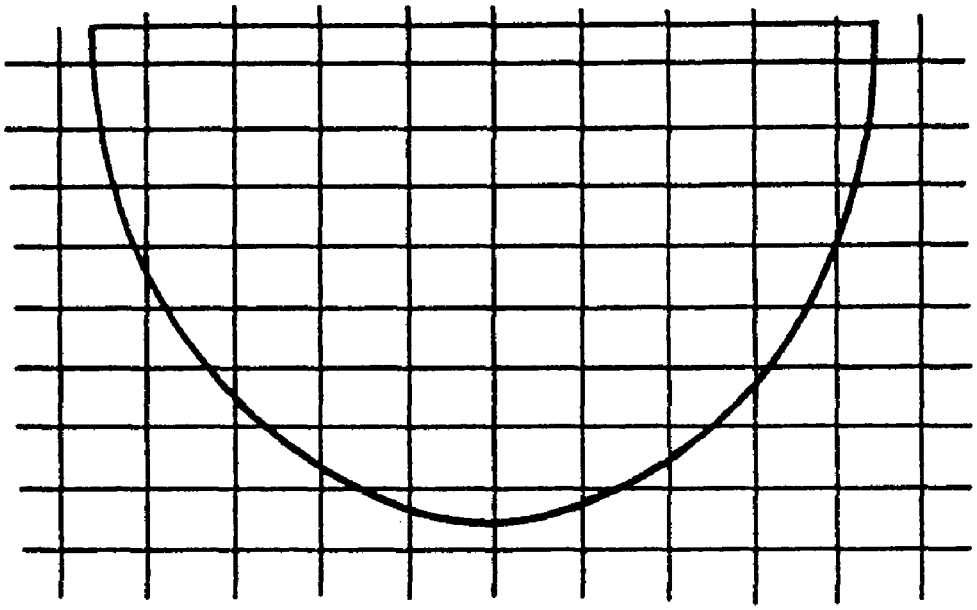
FIG. 11 Schematic of a slice with the field subdivisions.

During acquisition, a slice of the mixture is partitioned into separate fields of view, each 5 mm by 6.7 mm. FIG. 11 shows a sketch of a slice with these field subdivisions. Each field contains approximately 10,000 particles and is digitized into 480×512 pixels, with each pixel possessing a gray level on a scale from 0 to 255. During processing, each field of view is further subdivided into regularly spaced regions, hereon called "patches". The local composition is measured for each of these small patches by computing the mean gray level intensity of the pixels in the patch. The patches become the smallest area evaluated in the experiments. Therefore, the patch size determines the scale of examination in the mixing analysis. Although averaging within patches "blurs"

some of the image detail, the patches are small, and the large number of patches used in the analysis ($10^3$ to $10^4$ per slice) gives a detailed characterization of the composition statistics of the entire mixture.

Statistics such as the mean, mode, and standard deviation are computed for each patch. These data and the raw pixel values of the field image are written in separate files for post-processing and analysis. After the data is collected for a field, the program executes a command to move the xy-table to the next field address. This sequence of data collection and move commands is repeated until the entire slice is scanned.

Figure 12A:
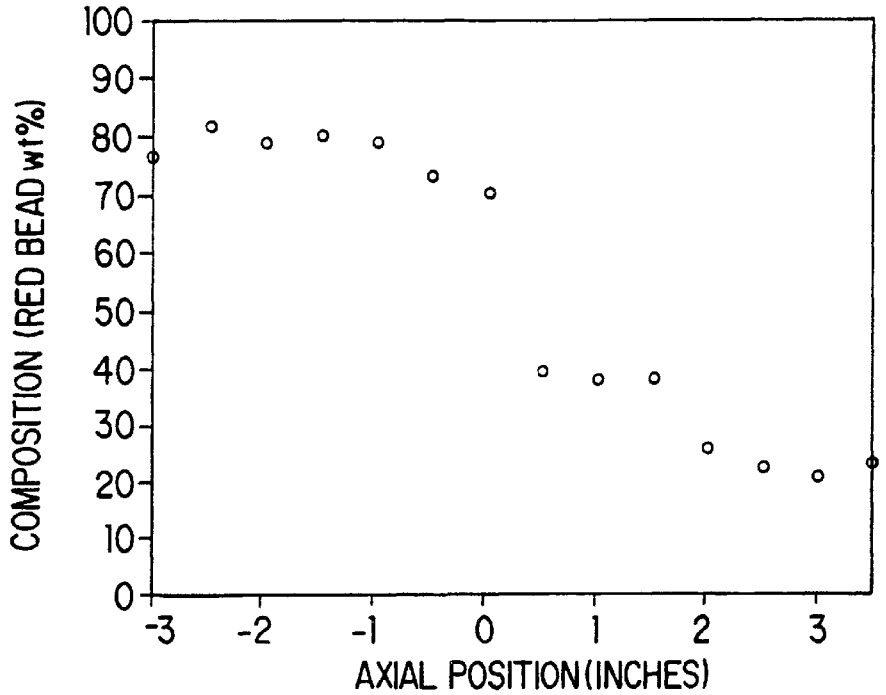
FIG. 12 Influence of mixing parameters on the bead composition profile after mixing at 16 rpm for 10 minutes (a)
Figure 12B:
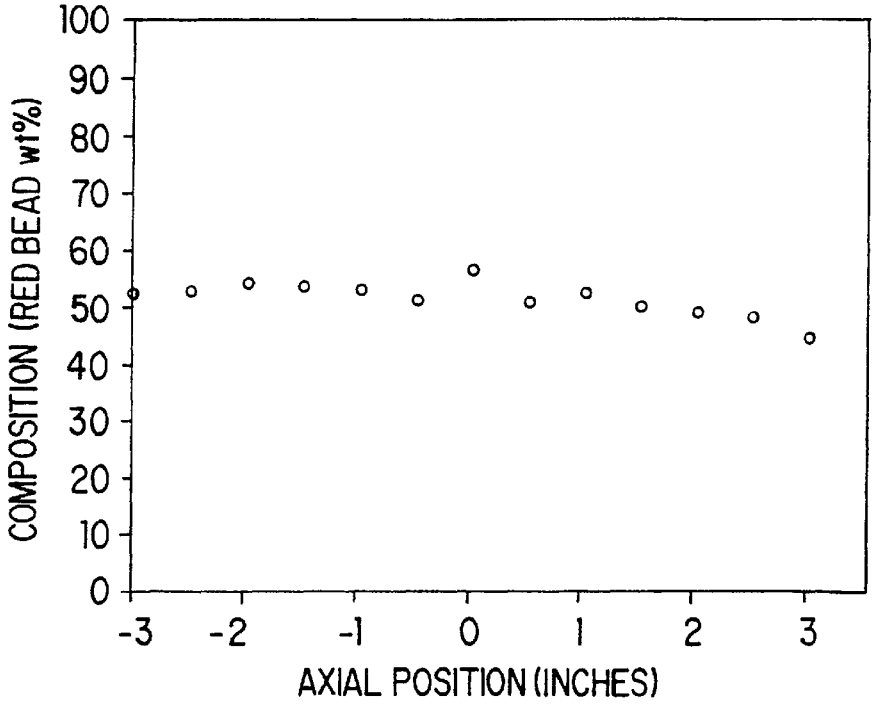
Figure 13A:
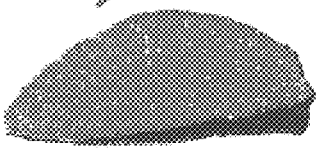
Figure 13B:
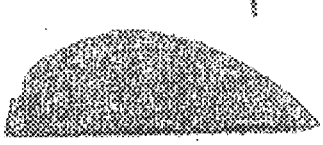
Figure 13C:
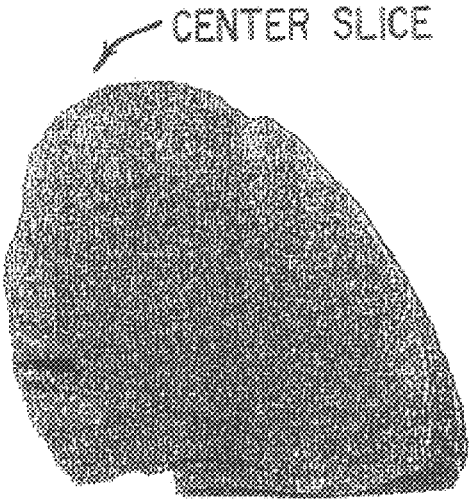
Figure 13D:
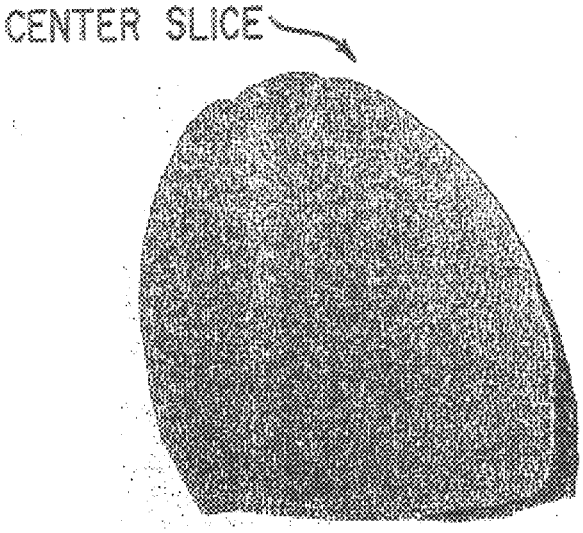
Figure 13E:
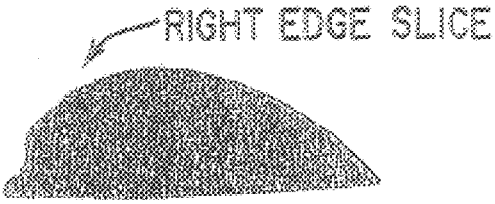
Figure 13F:
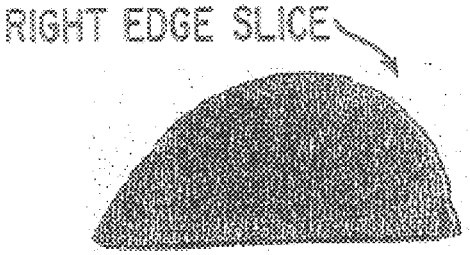

A quantitative comparison between pure rotation and rotation with rocking is shown in FIG. 12, both experiments were carried out under the same conditions as in FIG. 9. Composition versus axial position is shown for both conditions. The most striking feature of the graphs is the large disparity in composition between the left half of the twin shell and the right half for the case of pure rotation. Each location in the left half of the shell (originally red) contains at least 70 percent red particles. In the right half of the shell (originally green) all slices contain less than 40 percent red particles. In this case each half of the twin shell is fairly well mixed, however the entire mixture is quite segregated. In the case where rocking is used, the composition of all slices are close to 50 percent. This point can be further illustrated by comparing the left edge, center and right edge slices of each experiment (FIG. 13). The qualitative differences seen in the photographs are shown quantitatively in FIG. 14. The probability distribution functions for the pure rotation case are quite distinct from each other, demonstrating a lack of mixing in the axial direction. Both experiments show that once particles cross the boundary from one shell to the other, they become mixed relatively quickly as evidenced by the standard deviation of samples within those slices ranging from 5.8% to 6.3%. The center slice in the pure rotation case (FIG. 14, view a-2) shows a greater amount of segregation than any other slice due to the slow diffusive mixing of particles across the centerline of the mixer. Correspondingly its standard deviation (9.5%) of sample compositions is 50% greater than any other slice. The case with rocking shows that each slice has approximately the same standard deviation (6%) and has a composition within 10% of the overall mean (52% red). The overall probability density functions for both mixtures are shown in FIG. 15. The distribution for the pure rotation case is bimodal, while the case with rocking has a normal distribution. While the means of both mixtures are essentially the same (52% red), the relative standard deviation of the case with pure rotation is 23.9% compared to 6.9% for the case with rocking.

Based on evidence from both the visualization experiments and the solidification experiments, it is apparent that once the beads cross the boundary between a given pair of adjacent slices, the beads become mixed within the slice relatively quickly. Hence, it is the slow motion along the axis that limits the mixing process in a conventional V-blender. The effect of the rocking motion is to add a convective flow to the system in the axial direction. It is apparent from the experimental evidence that a V-blender such as the one described in this application, in which axial convective motion across the centerline of mixing vessels is added, will greatly enhance the rate of mixing and hence reduce the mixing time.

The techniques described in this application can be applied directly to the design of small scale lab equipment. Although size and weight concerns may prevent the application of rocking to large scale equipment, axial flow perturbations could be used in a different manner to yield similar enhancements. One method of accomplishing this is to use a rotating ribbon attached to an intensifier bar which could be retrofitted in large scale equipment. Efficient mixing would be accomplished by repeatedly reversing the direction of rotation of the ribbon, creating an axial flow across the center boundary necessary to enhance mixing in the same manner as if rocking had been applied.

The effects of flow perturbations on the mixing rate in a V-blender were examined. Rocking motion perturbs the rotational particle flow by adding a convective flow component in the axial direction. Mixing is greatly enhanced by such flow perturbations. On a laboratory scale, same size particles are mixed faster and more thoroughly using a rocking V-blender than a conventional V-blender.

Commerical V-Blenders can be modified so as to produce the axial flow perturbations described herein and create an improved V-blender capable of enhanced mixing. An example of such modification is wherein an intensifier bar in a V-blender is fitted with a rotating ribbon capable of creating a controlled perturbation of the flow. In addition, the motors for the shell and/or intensifier bar could be replaced with a variable speed reversible motors equipped with programmable controllers.

What is claimed is:

1. A method for mixing solids in a V-blender, said V-blender having a shell with an axis of rotation, comprising controlled axial flow perturbation of the solids being mixed, wherein the controlled axial flow perturbation is introduced by combined time-dependent rotation speed of the shell with a rocking motion, the rocking motion is defined by a speed of rotation of the shell of about 0 to about 50 rpm, a rocking angle of about 0° to about +10 degrees or −10 degrees, and a rock to roll frequency of about 0 to about 31.4, and the time-dependent rotation speed of the shell is defined by a frequency of rotation speed changes per revolution of about 0 to about 1.

2. A method for mixing solids in a V-blender, said V-blender having a shell with an axis of rotation, comprising controlled axial flow perturbation of the solids being mixed, wherein the controlled axial flow perturbation is introduced by combined time-dependent, reversible rotation direction of the shell with a rocking motion, the rocking motion is defined by a rocking angle of about 0° to about +10 degrees or −10 degrees, and a rock to roll frequency of about 0 to about 31.4, and the time-dependent, reversible rotation direction of the shell is defined by a speed of rotation of the shell of about 0 to about 50 rpm, and a frequency of rotation direction changes per revolution of about 0 to about 1.

3. A method for mixing solids in a V-blender, said V-blender having a shell with an axis of rotation, said shell having an intensifier bar which is rotatably mounted along the axis of rotation and a ribbon fixed to the intensifier bar, comprising controlled axial flow perturbation of the solids being mixed, wherein the controlled axial flow perturbation is introduced by combined rotation of the shell with rotation of the ribbon-bearing intensifier bar, the rotation of the shell is defined by a speed of rotation of the shell of about 0 to about 50 rpm and the ribbon-bearing intensifier bar rotation is defined by a ribbon speed of about 0 to about 3600 rpm.

4. A method for mixing solids in a V-blender, said V-blender having a shell with an axis of rotation, said shell having an intensifier bar which is rotatably mounted along the axis of rotation and a ribbon fixed to the intensifier bar, comprising controlled axial flow perturbation of the solids being mixed, wherein the controlled axial flow perturbation is introduced by combined rotation of the shell with time-dependent direction of rotation of the ribbon-bearing intensifier bar, the speed of rotation of the shell is about 0 to about 50 rpm, and the time-dependent direction of rotation of the ribbon-bearing intensifier bar is defined by a rotation speed of the ribbon-bearing intensifier bar of about 0 to about 3600 rpm and a frequency of rotation direction changes of the ribbon-bearing intensifier bar per shell revolution of about 0 to about 1.

* * * * *